US010823513B2

(12) United States Patent
Bugler et al.

(10) Patent No.: US 10,823,513 B2
(45) Date of Patent: Nov. 3, 2020

(54) ARROWHEAD FIN FOR HEAT EXCHANGE TUBING

(71) Applicant: Evapco, Inc., Taneytown, MD (US)

(72) Inventors: Thomas W. Bugler, Frederick, MD (US); Jean-Pierre Libert, Frederick, MD (US); Mark Huber, Sykesville, MD (US); Aaron Reilly, Taneytown, MD (US)

(73) Assignee: Evapco, Inc., Taneytown, MD (US)

( * ) Notice: Subject to any disclaimer, the term of this patent is extended or adjusted under 35 U.S.C. 154(b) by 0 days.

(21) Appl. No.: 15/425,454

(22) Filed: Feb. 6, 2017

(65) Prior Publication Data

US 2018/0023901 A1 Jan. 25, 2018

Related U.S. Application Data

(60) Provisional application No. 62/291,196, filed on Feb. 4, 2016.

(51) Int. Cl.
*F28F 1/16* (2006.01)
*F28F 13/12* (2006.01)
(Continued)

(52) U.S. Cl.
CPC ..... *F28F 1/16* (2013.01); *F28B 1/06* (2013.01); *F28F 1/04* (2013.01); *F28F 1/126* (2013.01); *F28F 1/26* (2013.01); *F28F 1/40* (2013.01); *F28F 13/12* (2013.01); *F28F 1/02* (2013.01); *F28F 3/025* (2013.01); *F28F 2215/10* (2013.01)

(58) Field of Classification Search
CPC ..... F28F 1/16; F28F 1/04; F28F 1/26; F28F 1/325; F28F 1/32; F28F 2215/00; F28F 1/126; F28B 1/06; F28D 1/0477
See application file for complete search history.

(56) References Cited

U.S. PATENT DOCUMENTS 2,677,394 A 5/1954 Brinen et al.
3,367,132 A * 2/1968 Elliott ..... F24D 3/00 165/55

(Continued)

FOREIGN PATENT DOCUMENTS

JP 1089873 4/1998

OTHER PUBLICATIONS

International Search Report issued in co-pending International Patent Application No. PCT/US17/16689 dated May 11, 2017.

(Continued)

*Primary Examiner* — Travis C Ruby
*Assistant Examiner* — Harry E Arant
(74) *Attorney, Agent, or Firm* — Whiteford, Taylor & Preston, LLP; Peter J. Davis

(57) ABSTRACT

A new heat exchange tube fin design in which a plurality of arrowhead shapes are pressed into or embossed onto each fin, the arrowhead shape defined by two intersecting wedge sections. The pressed arrowhead shapes are grouped into nested pairs, and one of the arrowheads in a pair is pressed as a positive relative to the fin plane and the other of the pair is pressed as a negative relative to the fin plane. The arrowhead pairs are placed in rows parallel to the air flow direction and arrowhead pairs in one row are preferably staggered relative to the arrowhead pairs in the adjacent row along the fin in the air flow direction.

10 Claims, 7 Drawing Sheets

(51) Int. Cl.

| | |
|---|---|
| ***F28F 1/40*** | (2006.01) |
| ***F28F 1/12*** | (2006.01) |
| ***F28B 1/06*** | (2006.01) |
| ***F28F 1/04*** | (2006.01) |
| ***F28F 1/26*** | (2006.01) |
| *F28F 3/02* | (2006.01) |
| *F28F 1/02* | (2006.01) |

(56) References Cited

U.S. PATENT DOCUMENTS

| | | | | |
|---|---|---|---|---|
| 3,397,741 | A | 8/1968 | Gunter | |
| 4,470,452 | A | 9/1984 | Rhodes | |
| 4,513,813 | A | 4/1985 | Zanobini | |
| 4,817,709 | A | 4/1989 | Esformes | |
| 4,984,626 | A | 1/1991 | Esformes et al. | |
| 5,111,876 | A | 5/1992 | Nash | |
| 2002/0074105 | A1 | 6/2002 | Hayashi et al. | |
| 2004/0194936 | A1 | 10/2004 | Torii | |
| 2012/0024511 | A1 | 2/2012 | Harada | |
| 2012/0318485 | A1 | 12/2012 | Yabe et al. | |
| 2013/0087318 | A1* | 4/2013 | Nakano | F28F 1/126 165/181 |
| 2015/0192372 | A1* | 7/2015 | Mun | F28F 1/40 165/174 |

OTHER PUBLICATIONS

Supplementary European Search Report issued in co-pending European application No. 17748341 dated Sep. 2, 2019.

* cited by examiner

SECTION A-A

SECTION B-B

ARROWHEAD FIN FOR HEAT EXCHANGE TUBING

FIELD OF THE INVENTION

This invention relates generally to tube fins for large scale field-erected air cooled industrial steam condensers or dry coolers/condensers.

BACKGROUND OF THE INVENTION

The current finned tube used in most large scale field erected air cooled industrial steam condensers (ACC) uses a flattened tube that is approximately 11 meters long by 200 mm wide (also referred to as "air travel length") with semi-circular leading and trailing edges, and 18.7 mm external height (perpendicular to the air travel length). Tube wall thickness is 1.35 mm. Fins are brazed to both flat sides of each tube and have a length that extends perpendicular to the longitudinal axis of the tube. The fins are usually 18.5 mm tall, spaced at 11 fins per inch. The fin surface has a wavy pattern to enhance heat transfer and help fin stiffness. The standard spacing between tubes, center to center, is 57.2 mm. The tubes themselves make up approximately one third of the cross sectional face area (perpendicular to the air flow direction); whereas the fins make up nearly two thirds of the cross section face area. There is a small space between adjacent fin tips of 1.5 mm. For summer ambient conditions, maximum steam velocity through the tubes can typically be as high as 28 mps, and more typically 23 to 25 mps.

SUMMARY OF THE INVENTION

The present invention is a new fin design to improve heat transfer between the fluid in the tube and the fluid (air) passing over/through the fins. The fin is generally planar and is in direct contact with a flattened ACC tube. The internal dimension of the tube in the direction parallel to the flat sides (also call the air travel length) is typically 200 mm. The external tube height (perpendicular to the air travel length is typically 18.7 mm, although fins of the present invention may be used with heat exchange tubes of any dimension. The fluid to be cooled flows in the tube, which is perpendicular to the fin plane. Cooling air flows parallel to the plane of the flat side of the tube and perpendicular to the longitudinal axis of the tube.

According to an embodiment of the invention, a plurality of arrowhead shapes are pressed into or embossed onto each fin. According to a preferred embodiment, the arrowhead shape is defined by two intersecting wedge sections. The shapes of the volume described by the embossed metal surface and the plane of the flat fin may be characterized as similar in form to a prism. According to a preferred embodiment, the wedge sections are triangular in cross section normal to their length. According to another preferred embodiment, the two intersecting wedge sections form a pointed end at the leading edge of the arrowhead shape and a forked end at the trailing edge of the arrowhead shape.

According to a more preferred embodiment, the height of each wedge (in a direction perpendicular to the plane of the fin is 50% or approximately 50% of the distance between adjacent fins. The leading and trailing edges of each wedge are preferably oriented at 30° or approximately 30° from the air flow direction/longitudinal axis of the fin. The top wedge section (relative to the location of the tube) forming an arrowhead shape has leading and trailing edges oriented 30° up, and the lower wedge section for each arrowhead shape has leading and trailing edges oriented 30° down.

According to a further preferred embodiment, the pressed arrowhead shapes according to the invention are grouped into pairs, where a first arrowhead shape of a pair is immediately upstream of the second arrowhead shape in the pair. According to a further preferred embodiment, the pointed end of the second arrowhead shape is nested into the back end (or "forked end" of the first arrowhead shape. According to a further preferred embodiment one of the arrowheads in a pair is pressed as a positive relative to the fin plane and the other of the pair is pressed as a negative relative to the fin plane.

According to another embodiment of the invention, the arrowhead pairs are placed in rows parallel to the air flow direction and spaced normal to the air flow direction one to two times the fin width dimension. Arrowhead pairs in one row are preferably staggered relative to the arrowhead pairs in the adjacent row along the fin in the air flow direction. So the first arrowhead in the second row is spaced down the air flow direction along the fin by half of the space between arrowhead pairs along the rows.

According to another embodiment of the invention, the arrowhead pairs in a single row are spaced in the direction of air flow according to a multiple of the fin spacing, preferably 6 to 12 times the fin spacing and more preferably 8 or 9 times the fin spacing.

According to another embodiment of the invention, the dimensions of the arrowheads are a function of the fin height. The arrowhead width (normal to the flow in the plane of the fin) is preferably nominally 2 to 3 times fin spacing (0.209"=2.3*0.091"). The arrowhead length (parallel to the flow) is preferably 5 to 8 times the fin spacing (0.091*6.5=0.591) (0.41+0.181=) 0.591.

According to another embodiment of the invention, all arrowhead pressings on a given fin point in the same direction with respect to the flow direction. With each subsequent fin, the arrowhead pressings alternate between pointing in the flow direction and against the flow direction.

DETAILED DESCRIPTION OF THE INVENTION

Figure 1:
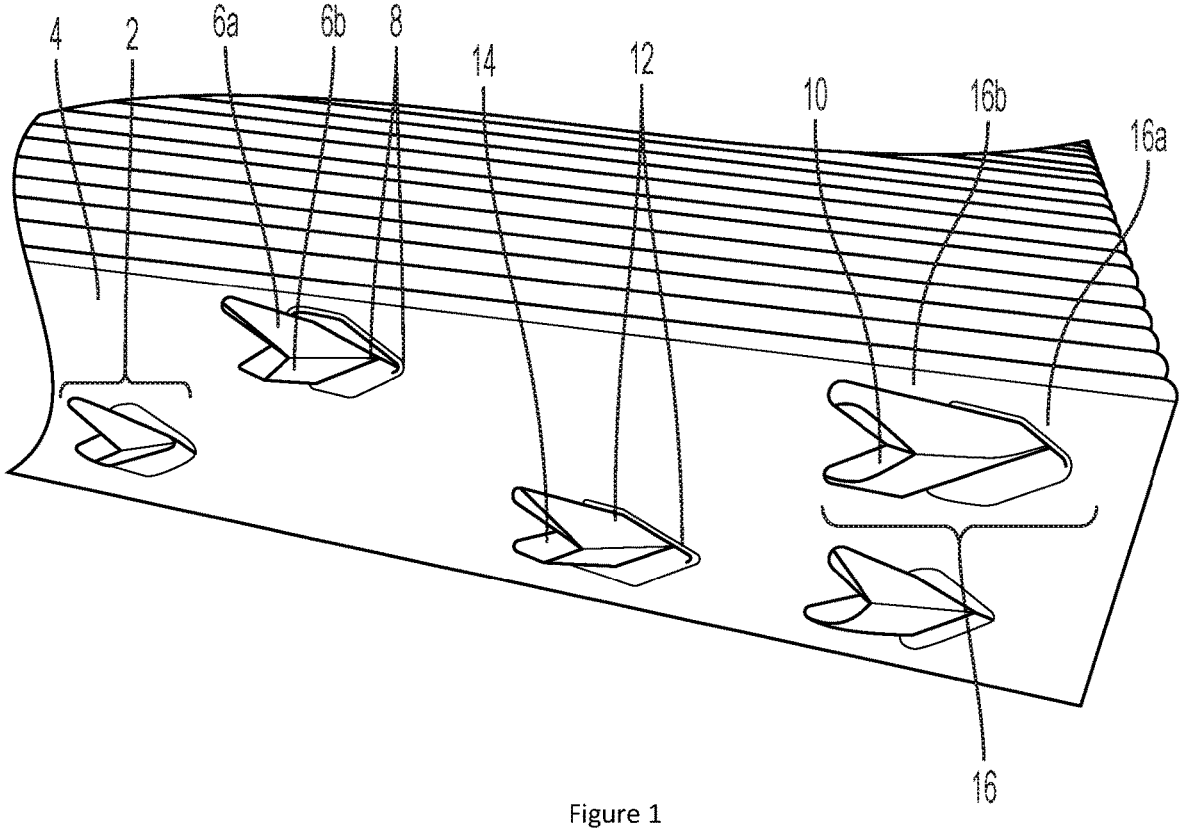
FIG. 1 is perspective view of a fin according to an embodiment of the invention.

Referring to the Figures, and in particular, FIGS. 1, 2, 4, 10 and 11, a plurality of arrowhead shapes 2 are pressed into or embossed onto each fin 4. Each arrowhead shape 2 is defined by two intersecting wedge sections 6*a*, 6*b*. The shapes of the volume described by the embossed metal surface and the plane of the flat fin may be characterized as similar in form to a prism. The wedge sections 6*a*, 6*b* are triangular in cross section normal to their length. The two intersecting wedge sections 6*a*, 6*b* form a pointed end 8 at the leading end of the arrowhead shape 2 and a forked end 10 at the trailing end of the arrowhead shape 2.

The height of each wedge 6*a*, 6*b* (in a direction perpendicular to the plane of the fin is 50% or approximately 50% of the distance between adjacent fins 4 (See FIGS. 5-7 and 9). The leading edges 12 and trailing edges 14 of each wedge are preferably oriented at 30° or approximately 30° from the air flow direction/longitudinal axis of the fin 4. The top wedge section 6*a* (relative to the location of the tube) forming an arrowhead shape 2 has leading and trailing edges oriented 30° up, and the lower wedge section 6*b* for each arrowhead shape 2 has leading and trailing edges 12, 14 oriented 30° down.

Figure 2:
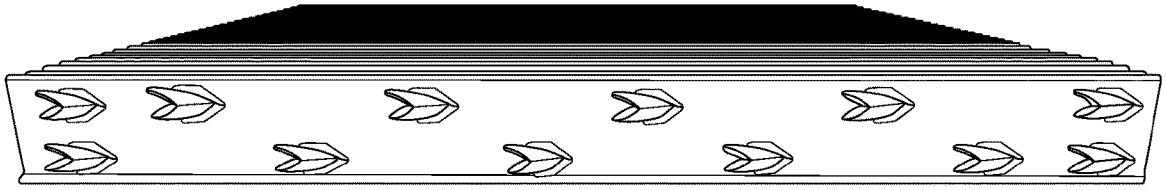
FIG. 2 is an excerpt from FIG. 3 showing a side view of an embodiment of the invention.
Figure 3:
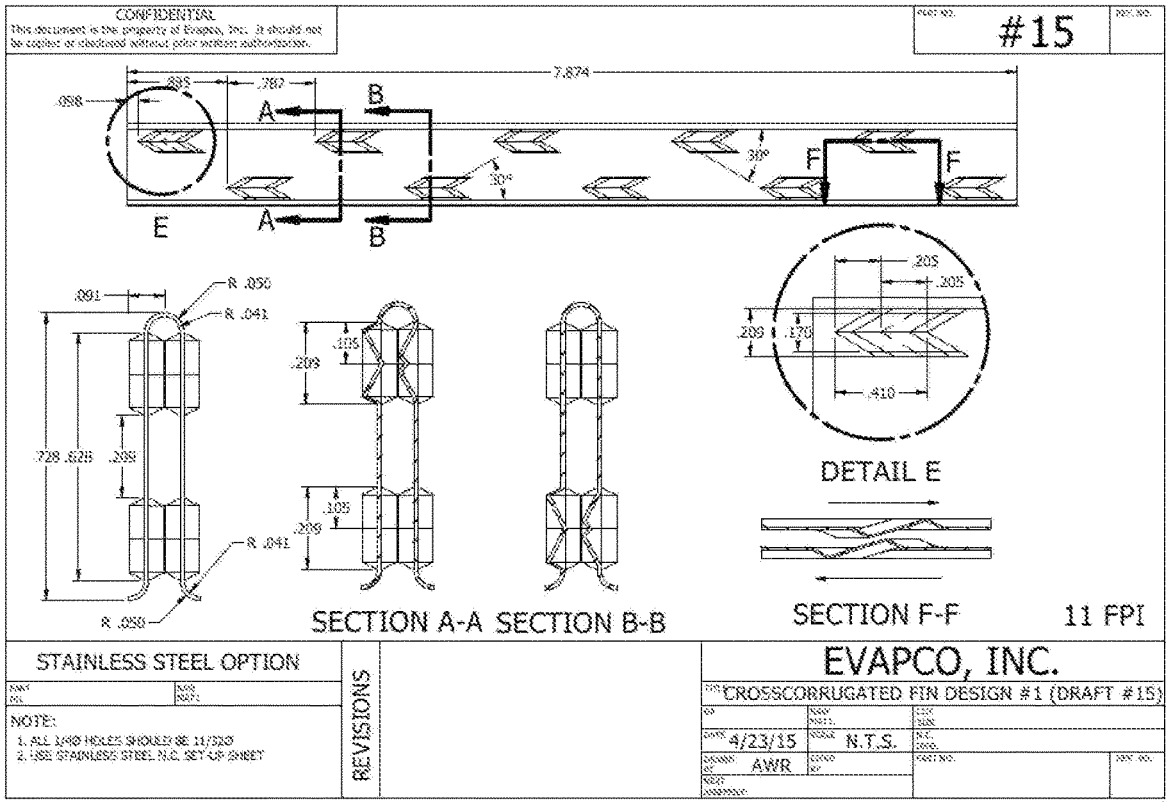
FIG. 3 is an excerpt from FIG. 3 showing an end view of an embodiment of the invention.
Figure 4:
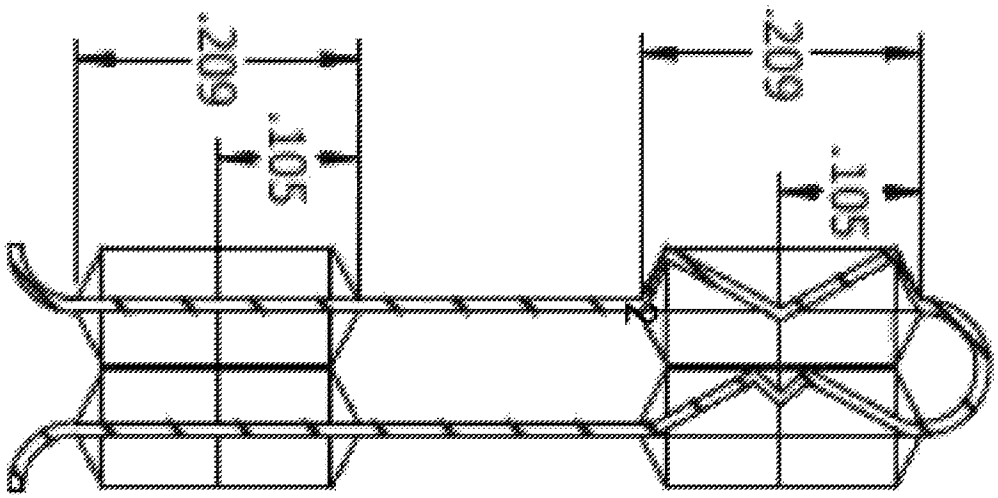
FIG. 4 is an excerpt from FIG. 3 showing a cross-sectional view of an embodiment of the invention along line A-A in FIG. 3.
Figure 5:
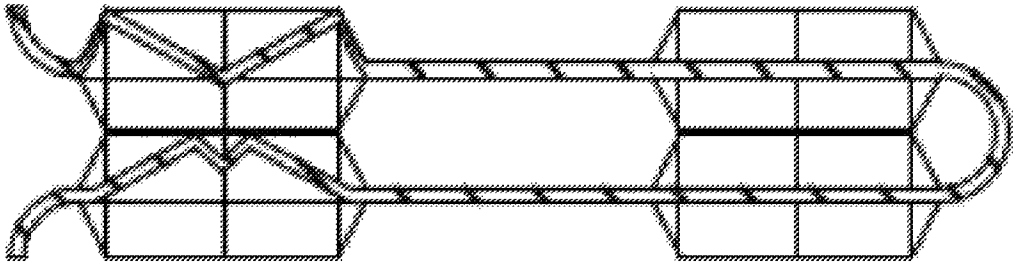
FIG. 5 is an excerpt from FIG. 3 showing a cross-sectional view of an embodiment of the invention along line B-B in FIG. 3.
Figure 6:
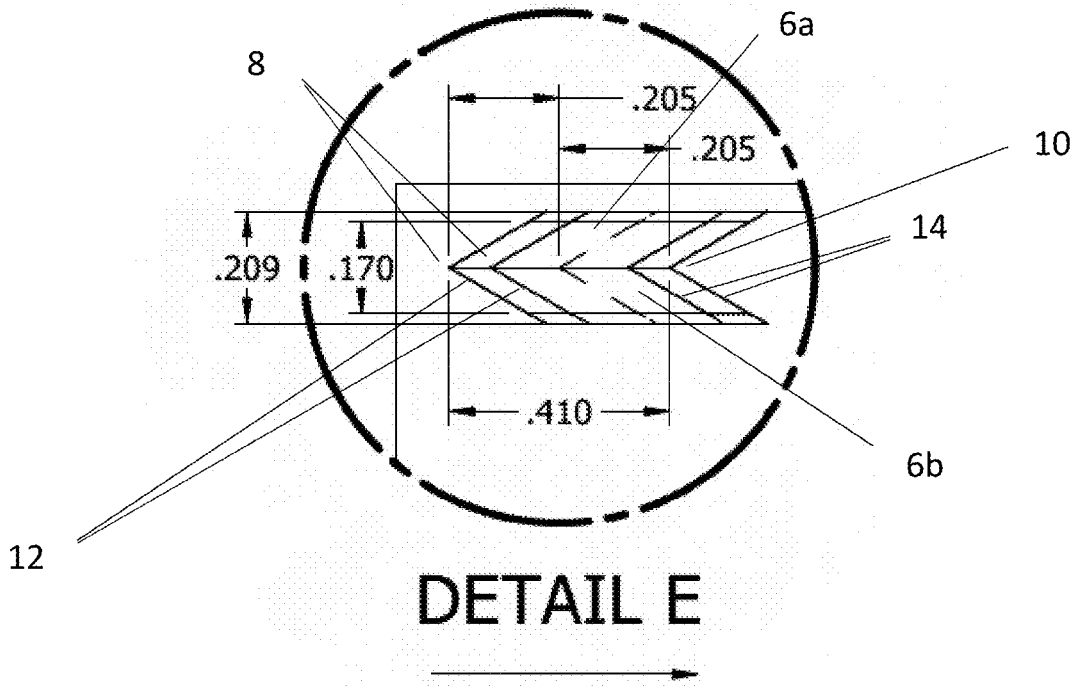
FIG. 6 is an excerpt from FIG. 3 showing Detail E from FIG. 3.
Figure 7:
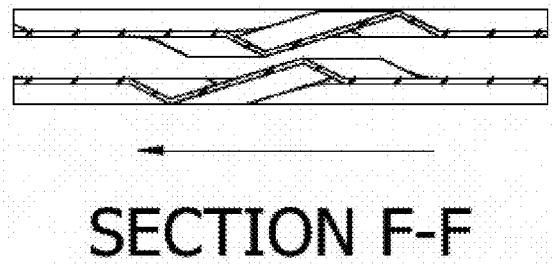
FIG. 7 is an excerpt from FIG. 3 showing a cross-sectional view of an embodiment of the invention along line F-F in FIG. 3.
Figure 8:
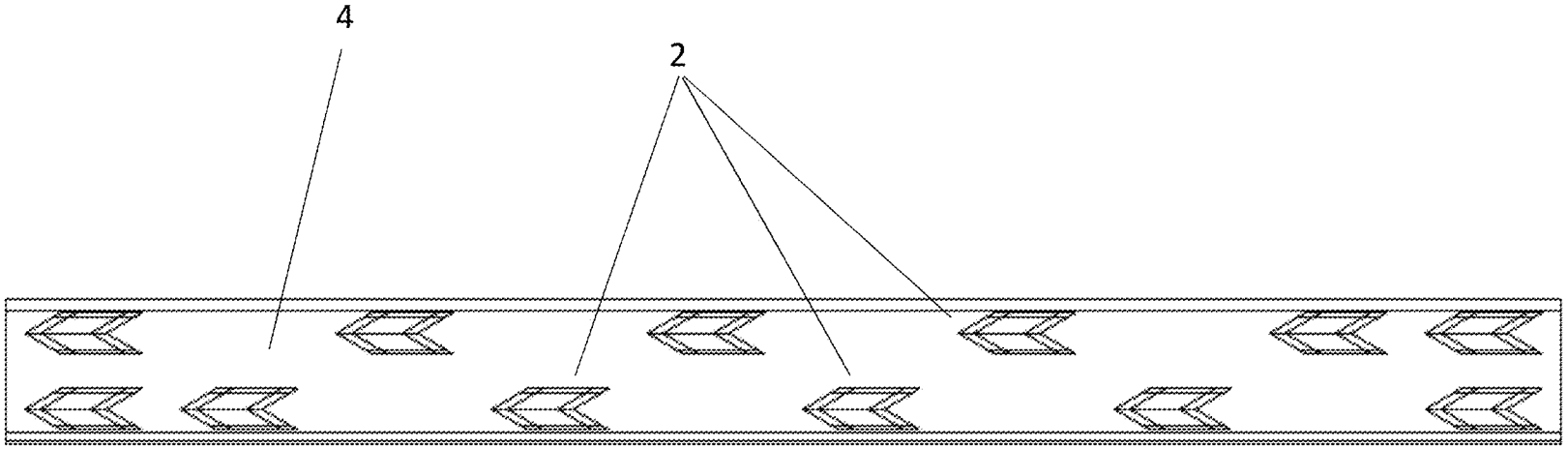
FIG. 8 is a side view according to another embodiment of the invention.
Figure 9:
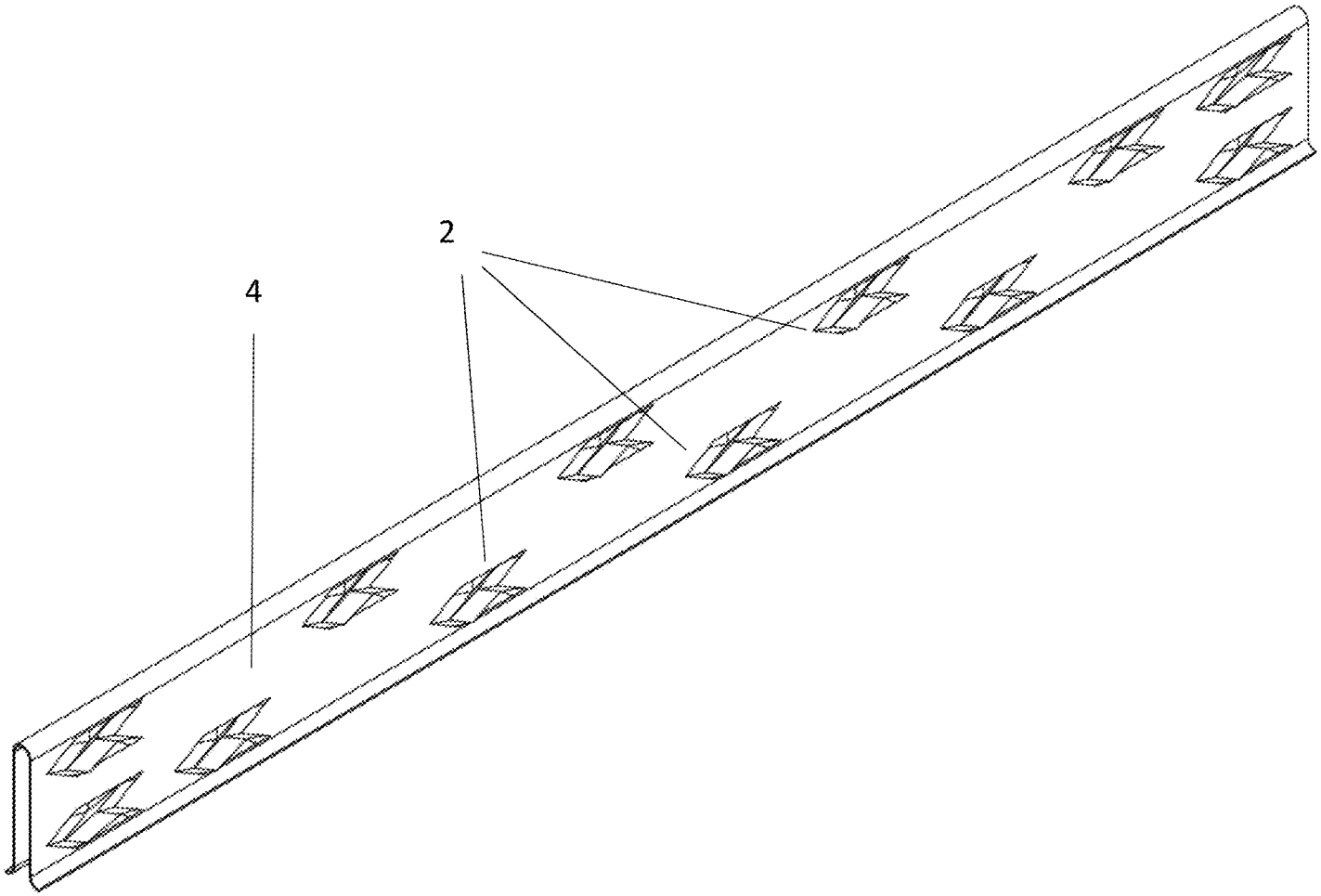
FIG. 9 is a perspective view according to another embodiment of the invention.

Referring in particular to FIGS. 1 and 2, the pressed arrowhead shapes 2 may be grouped into pairs 16, where a first arrowhead shape 16*a* of a pair is immediately upstream of the second arrowhead shape 16*b* in the pair. The pointed end of the second arrowhead shape 16*b* may be nested into the back end (or "forked end") of the first arrowhead shape 16*a*. Consistent with a preferred embodiment of the invention, FIG. 1 shows one of the arrowheads in a pair pressed as a positive relative to the fin plane (out of the fin plane) and the other of the pair pressed as a negative relative to the fin plane (into the fin plane).

FIGS. 1, 4, 10 and 11 show the arrowhead pairs placed in two rows parallel to the air flow direction. The rows are spaced from one-another normal to the air flow direction one to two times the fin width dimension. The arrowhead pairs in one row are shown staggered relative to the arrowhead pairs in the adjacent row along the fin in the air flow direction so that first arrowhead in the second row is spaced down the air flow direction along the fin by half of the space between arrowhead pairs along the rows.

Referring to FIGS. 1, 2, 4, 10 and 11, the arrowhead pairs in a single row are shown spaced in the direction of air flow according to a multiple of the fin spacing, preferably 6 to 12 times the fin spacing and more preferably 8 or 9 times the fin spacing.

The dimensions of the arrowheads are preferably a function of the fin height. The arrowhead width (normal to the flow in the plane of the fin) is preferably nominally 2 to 3 times fin spacing (0.209"=2.3*0.091"). The arrowhead length (parallel to the flow) is preferably 5 to 8 times the fin spacing (0.091*6.5=0.591) (0.41+0.181=) 0.591.

All arrowhead pressings on a given fin point in the same direction with respect to the flow direction. With each subsequent fin, the arrowhead pressings alternate between pointing in the flow direction and against the flow direction.

The invention claimed is:

1. A fin for a heat exchange tube comprising a plurality of single fin segments arranged parallel to one-another and spaced apart from one-another along a space separating adjacent surfaces of a pair of heat exchange tubes, each single fin segment having a front surface and a reverse surface, and each said fin segment surface comprising arrowhead shapes arranged along a longitudinal axis of said single fin segment, said longitudinal axis parallel to an air flow direction along said fin; wherein said arrowhead shapes are arranged into arrowhead pairs, each arrowhead pair comprising an indented arrowhead shape and a raised arrowhead shape, where a pointed end of one arrowhead shape of a pair shares a point on the fin segment with a forked end of a second arrowhead shape of the pair, and wherein said pairs of arrowhead shapes are spaced apart along a plane parallel with said longitudinal axis, the pointed end of each arrowhead pair separated from the forked end of an adjacent arrowhead pair by a portion of said fin that is flat.

2. The fin according to claim 1, wherein said arrowhead pairs each comprise two intersecting arrowhead shapes, a first arrowhead shape comprising said indented arrowhead shape and a second arrowhead shape comprising said raised arrowhead shape.

3. The fin according to claim 1, wherein said arrowhead shapes are arranged in two or more rows on each fin segment, said rows aligned with and parallel to said longitudinal axis of said fin segment.

4. The fin according to claim 1, wherein a first plurality of said arrowhead shapes are pressed in a first direction perpendicular to a plane of said fin, and a second plurality of said arrowhead shapes are pressed in a second direction perpendicular to said plane of said fin, said second direction opposite to said first direction.

5. The fin according to claim 1, wherein a first arrowhead shape of an arrowhead pair is pressed in a first direction perpendicular to a plane of said fin, and a second arrowhead shapes of said arrowhead pair is pressed in a second direction perpendicular to said plane of said fin, said second direction opposite to said first direction.

6. A heat exchange tube having a fin attached thereto, said fin comprising a plurality of single fin segments, each single fin segment having a first surface and a reverse surface, and each said fin segment surface comprising arrowhead shapes arranged along a longitudinal axis of said single fin segment, said longitudinal axis parallel to an air flow direction along said fin; wherein said arrowhead shapes are arranged into arrowhead pairs, each arrowhead pair comprising an indented arrowhead shape and a raised arrowhead shape relative to a major plane of said first surface, where a pointed end of one arrowhead shape of a pair shares a point on the fin segment with a forked end of a second arrowhead shape of the pair, and wherein said pairs of arrowhead shapes are spaced apart along a plane parallel with said longitudinal axis, the pointed end of each arrowhead pair separated from the forked end of an adjacent arrowhead pair by a portion of said fin that is flat.

7. A field erected air cooled industrial steam condenser comprising a plurality of finned heat exchange tubes, said heat exchanged tubes each having a plurality of fins attached to an external surface of a flat surface of said tube aligned perpendicular to a longitudinal axis of said tube, said fins comprising a plurality of single fin segments extending between adjacent surfaces of a pair of heat exchange tubes, each single fin segment having a first surface and a reverse surface, and each said fin segment surface comprising arrowhead shapes arranged along a longitudinal axis of said single fin segment, said longitudinal axis parallel to an air flow direction along said fin; wherein said arrowhead shapes are arranged into arrowhead pairs, each arrowhead pair comprising an indented arrowhead shape and a raised arrowhead shape relative to a major plane of said first surface, where a pointed end of one arrowhead shape of a pair shares a point on the fin segment with a forked end of a second arrowhead shape of the pair, and wherein said pairs of arrowhead shapes are spaced apart along a plane parallel with said longitudinal axis, the pointed end of each arrowhead pair separated from the forked end of an adjacent arrowhead pair by a portion of said fin that is flat.

8. The field erected air cooled industrial steam condenser according to claim 7, wherein arrowhead pairs in a single row are spaced apart from one-another by a factor of 6 to 12 times the spacing between adjacent fins.

9. The field erected air cooled industrial steam condenser according to claim 7, wherein said arrowheads have a width that is 2 to 3 times the spacing between adjacent fins.

10. The field erected air cooled industrial steam condenser according to claim 7, wherein said arrowheads have a length that is 5 to 8 times the spacing between adjacent fins.

* * * * *